US010710765B2

(12) United States Patent
Wurster

(10) Patent No.: US 10,710,765 B2
(45) Date of Patent: Jul. 14, 2020

(54) BASE FOR HOT-FILL PLASTIC CONTAINERS

(71) Applicant: Graham Packaging Company, L.P., York, PA (US)

(72) Inventor: Michael P. Wurster, York, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 66 days.

(21) Appl. No.: 13/948,718

(22) Filed: Jul. 23, 2013

(65) Prior Publication Data

US 2015/0028041 A1 Jan. 29, 2015

(51) Int. Cl.

| | |
|---|---|
| ***B65D 1/16*** | (2006.01) |
| ***B65D 1/42*** | (2006.01) |
| ***B65D 1/02*** | (2006.01) |

(52) U.S. Cl.

CPC ..... *B65D 1/16* (2013.01); *B65D 1/0284* (2013.01); *B65D 1/42* (2013.01); *B65D 2501/0036* (2013.01)

(58) Field of Classification Search

CPC ..... B65D 1/16; B65D 1/42; B65D 1/0284
USPC ..... 220/608
See application file for complete search history.

(56) References Cited

U.S. PATENT DOCUMENTS

| | | | | |
|---|---|---|---|---|
| 4,048,934 | A | 9/1977 | Wallace | |
| 4,318,489 | A | 3/1982 | Snyder et al. | |
| 4,355,728 | A | 10/1982 | Ota et al. | |
| 4,465,199 | A | 8/1984 | Aoki | |
| 4,497,855 | A | 2/1985 | Agrawal et al. | |
| 5,234,126 | A | 8/1993 | Jonas et al. | |
| 5,269,437 | A | 12/1993 | Gygax | |
| 5,906,285 | A * | 5/1999 | Slat | 215/12.2 |
| 6,299,007 | B1 | 10/2001 | Takeuchi | |
| 6,460,714 | B1 | 10/2002 | Silvers et al. | |
| 6,896,147 | B2 | 5/2005 | Trude | |
| 8,424,709 | B2 * | 4/2013 | Boukobza | 220/675 |
| 8,444,002 | B2 | 5/2013 | Schneider et al. | |
| 2012/0076965 | A1 | 3/2012 | Silvers et al. | |
| 2013/0062306 | A1 * | 3/2013 | Quasters | 215/375 |

* cited by examiner

*Primary Examiner* — Andrew T Kirsch
(74) *Attorney, Agent, or Firm* — Stradley Ronon Stevens & Young, LLP

(57) ABSTRACT

A base structure for a blow-molded container having an annular sidewall and a central longitudinal axis, the base structure comprising: a bottom portion; an annular support heel positioned between the sidewall and the bottom portion, wherein the annular support heel is angled inwardly at an angle θ of from about 15° to about 65° relative a plane extending from the sidewall; and a plurality of partial sphere structures on the annular support heel and extending beyond the bottom portion thus forming a contact surface supporting the container, and wherein the blow-molded container comprises a material selected from the group consisting of a polyester resin and polypropylene.

18 Claims, 3 Drawing Sheets

BASE FOR HOT-FILL PLASTIC CONTAINERS

TECHNICAL FIELD

This invention relates to bases for polymeric containers used in hot fill, pasteurization, and retort applications that are able to withstand and recover from the heat associated with such processes with substantially no deformation.

BACKGROUND OF THE INVENTION

Blow molding processes for forming PET containers are well known in the art. PET plastic containers have replaced or provided an alternative to glass containers for many applications. However, few food products that must be processed using pasteurization or retort are available in plastic containers. Pasteurization and retort methods are frequently used for sterilizing solid or semi-solid food products, e.g., pickles and sauerkraut. The products may be packed into the container along with a liquid at a temperature less than 82° C. (180° F.) and then sealed and capped, or the product may be placed in the container that is then filled with liquid, which may have been previously heated, and the entire contents of the sealed and capped container are subsequently heated to a higher temperature. As used herein, "high-temperature" pasteurization and retort are sterilization processes in which the product is exposed to temperatures greater than about 80° C.

Pasteurization and retort differ from hot-fill processing by including heating the filled container to a specified temperature, typically greater than 93° C. (200° F.), until the contents of the filled container reach a specified temperature, for example 80° C. (175° F.), for a predetermined length of time. That is, the external temperature of the hot-filled container may be greater than 93° C. so that the internal temperature of a solid or semi-solid product reaches approximately 80° C. Retort processes also involve applying overpressure to the container. The rigors of such processing present significant challenges for the use of plastic containers, including containers designed for use in hot-fill processing. For example, during a retort process, when a plastic container is subjected to relatively high temperatures and pressures, the plastic container's shape will distort. Upon cooling, the plastic container generally retains this distorted shape or at least fails to return to its pre-retort shape.

Prior art base designs tend to deform significantly when their plastic blow-molded containers are exposed to a thermal process comprising, for example, heating the container to a temperature of from about 98° C. to about 127° C. for about 10 to about 40 minutes followed by cooling to about from 25° C. to about 37° C. in from about 10 minutes to about 30 minutes. Such temperatures are typical for hot fill applications as well as sterilization applications such as retort and pasteurization. The deformation typically manifests in a lean to the container—sometimes as much as from 3 to 5°. The perpendicularity of a plastic blow-molded container is important for the ability to properly apply a label, shelf appearance and the ability to stack containers on top of each other. Base deformation will also increase the risk of fracturing barrier layers applied to any food container needing improved oxygen performance. Accordingly, there is a need to provide plastic containers having base designs that can withstand such extreme conditions associated with pasteurization and retort processing.

SUMMARY OF THE INVENTION

The present invention satisfies this need by providing a base structure for a blow-molded container having an annular sidewall and a central longitudinal axis, the base structure comprising: a bottom portion; an annular support heel positioned between the sidewall and the bottom portion, wherein the annular support heel is angled inwardly at an angle θ of from about 15° to about 65° relative a plane extending from the sidewall; and a plurality of partial sphere structures on the annular support heel and extending beyond the bottom portion thus forming a contact surface supporting the container, and wherein the blow-molded container comprises a material selected from the group consisting of a polyester resin and polypropylene.

In another aspect of the present invention, the base structure remains substantially un-deformed when the blow-molded container is filled with a liquid and sealed and subjected to a thermal process comprising heating the container to a temperature of from about 98° C. to about 127° C. for about 10 to about 40 minutes followed by cooling to about from 25° C. to about 37° C. in from about 10 minutes to about 30 minutes, such that the blow-molded container does not lean more than 1° relative to the central longitudinal axis.

In another aspect of the present invention, the base structure remains substantially un-deformed when the blow-molded container is filled with a liquid and sealed and subjected to a thermal process comprising heating the container to a temperature of from about 108° C. to about 113° C. for about 20 to about 25 minutes followed by cooling to about 37° C. in from about 25 minutes to about 30 minutes, such that the blow-molded container does not lean more than 1° relative to the central longitudinal axis.

In yet another aspect, the present invention provides a base structure for a blow-molded container having an annular sidewall and a central longitudinal axis, the base structure comprising: a bottom portion; an annular support heel positioned between the sidewall and the bottom portion, wherein the annular support heel is angled inwardly at an angle θ of from about 15° to about 65° relative a plane extending from the sidewall; and a plurality of partial sphere structures on the annular support heel and extending beyond the bottom portion thus forming a contact surface supporting the container, and wherein the blow-molded container comprises poly(ethylene)terephthalate (PET).

The base structure of the present invention allows plastic containers such as, for example, PET containers, to better withstand the rigors of thermal processes such as, for example, retort/pasteurization and hot fill processes. The novel base reduces volume growth and allows for better recovery during such processes.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. All references cited herein are incorporated by reference as if each had been individually incorporated.

A preferred embodiment of the invention is discussed in detail below. While specific exemplary embodiments are discussed, it should be understood that this is done for illustration purposes only. A person skilled in the relevant art will recognize that other components and configurations can be used without parting from the spirit and scope of the invention.

The Container

The present invention provides a base structure for a blow-molded container having an annular sidewall and a central longitudinal axis, the base structure comprising: a bottom portion; an annular support heel positioned between the sidewall and the bottom portion, wherein the annular support heel is angled inwardly at an angle θ of from about 15° to about 65° relative a plane extending from the sidewall; and a plurality of sphere structures on the annular support heel and extending beyond the bottom portion thus forming a contact surface supporting the container, and wherein the blow-molded container comprises a material selected from the group consisting of a polyester resin and polypropylene.

Figure 1:
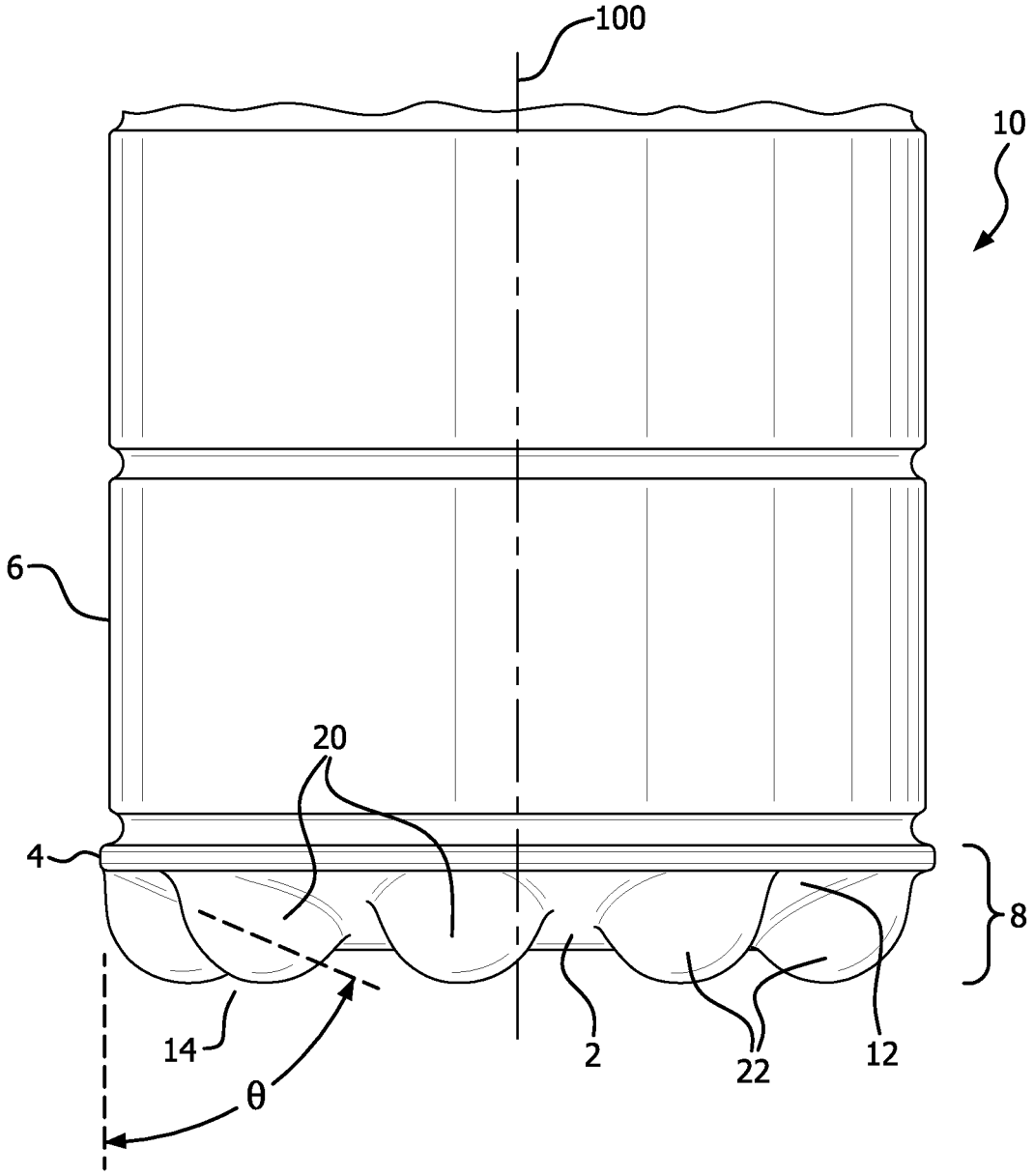
FIG. 1 shows a perspective view of a base structure and container according to the present invention.

Referring now to the drawings, FIG. 1 illustrates a blow-molded plastic container 10 such as may be used in the packaging of food products that require thermal processing during packaging. Such food products include liquids (which includes semi-solids) such as, for example, fruit juices, and fruits and vegetables in liquids such as, for example, peaches, pears, pickles, peas, sauerkraut, and the like. When such food products are packaged, they require exposure to high temperatures in connection with processes such as, for example, hot-fill, retort, and pasteurization to ensure bacteria is eliminated. Such containers can typically be designed to contain liquid volumes of, for example, 8 ounces, 10 ounces, 12 ounces, 15 ounces, 20 ounces, 24 ounces, 32 ounces, or the like. The container 10 comprises a base structure 8 for supporting the container 10. The container 10 has a longitudinal axis 100 when the container 10 is standing upright on its base 8. A sidewall 6 extends upwardly from the base 8.

Container 10 can have any geometry, shape or size. For example, container 10 can be round, oval, polygonal, and irregular. Suitable containers can be a jar-type, can-type, carafe, wide mouth and any other type container known to those of ordinary skill in the art. Suitable features of the containers can include pressure absorbing features, grip enhancing features, shoulders, bumpers, finishes, chimes, standing rings, necks and others know to those of ordinary skill in the art. In preferred embodiments, container 10 is in the form of a plastic (i.e. PET) can having a generally cylindrical side wall 6, bottom portion 2, and an open top circumscribed by a flange section (not shown). The flange section or cap (not shown) seals the container and confines the substance inside the container.

Container 10 is preferably a pressure-adjustable container, in particular a hot-fill container that is adapted to be filled with a substance at a temperature above room temperature. The container 10 may be formed in a manner described in U.S. patent application Publication No. 2012/0076965, which is incorporated herein by reference in its entirety. Container 10 may be a single layer plastic container or a multilayer plastic container comprising functional layers such as, for example, active and/or passive oxygen barrier layers.

In a preferred form of the invention, the container 10 will have sidewalls of varying thicknesses. Preferably, the sidewall has a density of between about 1.370 g/cc and 1.385 g/cc. Wall thicknesses in the base area can vary but for food container applications the thickness of the wall in the base area will be from about 0.012" (0.030 cm) to about 0.016" (0.040 cm).

Container 10 preferably comprises a material selected from the group consisting of a polyester resin and polypropylene. Suitable polyester resins include poly(ethylene)terephthalate (PET), homopolymers of poly(ethylene)-phthalate, copolymers of poly(ethylene)terephthalate, poly(ethylene)isophthalate, poly(ethylene)naphthalate, poly(dimethylene)terephthalate, and poly(butylene) terephthalate. In more preferred embodiments, the containers of the present invention comprise PET. Preferably, the PET has an intrinsic viscosity of from about 0.72 dL/g to about 0.86 dL/g. Suitable PET resins include bottle grade PET resins such as, for example, any of the PARASTAR® resins sold by the Eastman Chemical Company, and CLEAR TUF® resins sold by M&G Polymers.

Figure 2:
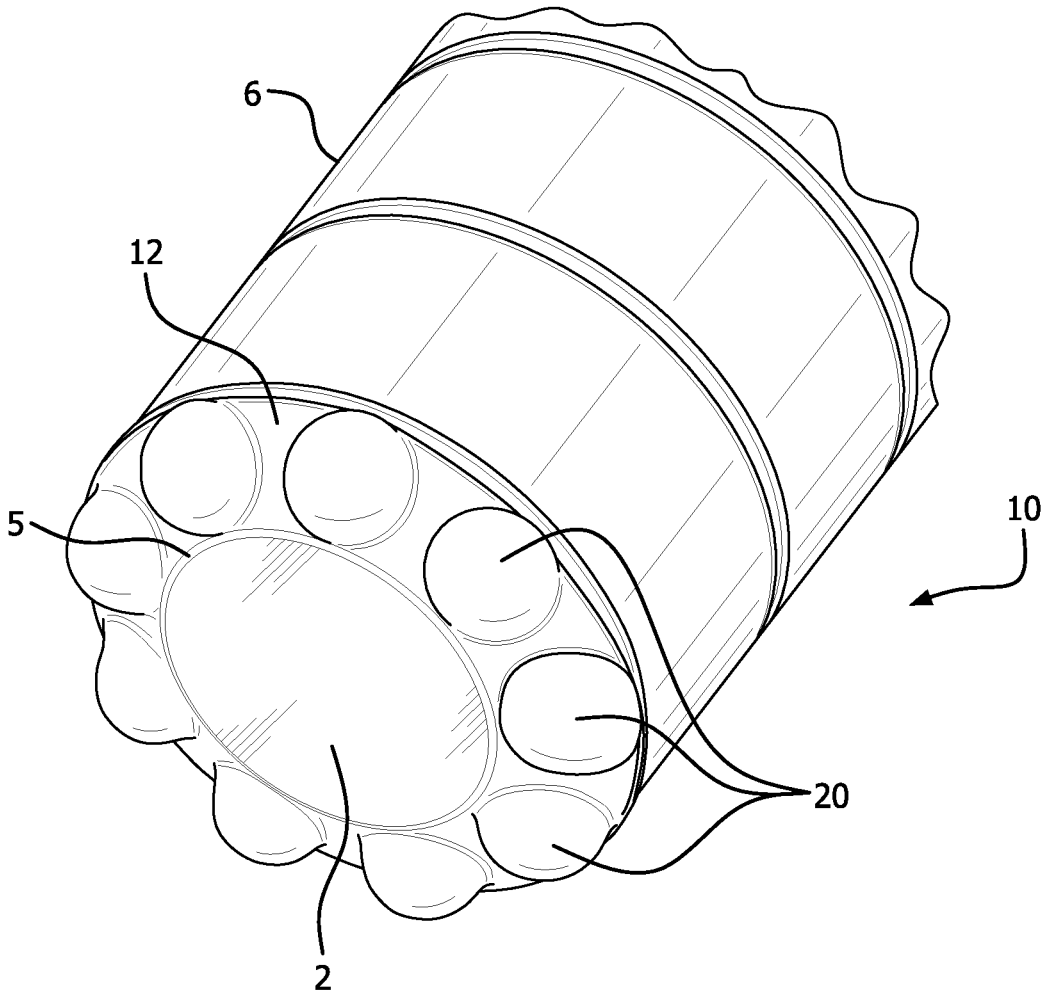
FIG. 2 shows another perspective view of the base structure and container of FIG. 1.

Referring to FIG. 1 and FIG. 2, base structure 8 comprises a bottom portion 2, an annular support heel 12 positioned between the sidewall 6 and the bottom portion 2, and a first rounded edge 4 between the sidewall 6 and the annular support heel 12 and a second rounded edge 5 between the annular support heel 12 and the bottom portion 2. Although shown in the figures as flat, in some embodiments bottom portion 2 can be concaved inwardly or concaved outwardly.

Annular support heel 12 generally has a "wedge" shape such that it is angled inwardly at an angle θ of from about 15° to about 65° relative a plane 14 extending from the sidewall 6. In some preferred embodiments, angle θ is from about 35° to about 65° , and in more preferred embodiments, angle θ is from about 45° to about 65° . Without intending to be bound by a particular theory, an angle in this range allows for the material to not stretch too much during the blow process thus resulting in a more even material distribution. The area of the diameter of bottom portion 2 will be affected by the angle. For example, if angle θ is 64° , the area of bottom portion 2 can be about 32% of the diameter of the base and if angle θ is 45° , the area of bottom portion 2 can be about 57% of the diameter of the base.

Annular support heel 12 further comprises a plurality of partial sphere structures 20 extending beyond the bottom portion 2 thus forming a contact surface 22 supporting the container 10. The partial sphere structures (or partial spheres) provide at least two benefits to the base structure and container. First, the partial spheres 20 provide the container 10 with top load strength that otherwise would not be present for the higher angles (i.e., above 45°) where top load strength of the container may be compromised. Next, because the partial spheres elevate or extend the container uniformly beyond the bottom portion 2 of the base structure 8, additional clearance is provided for variations in base recovery after thermal processing (e.g., retort), thus allowing the base to be more forgiving of a less-than-full recovery after distortions from the internal pressure changes associated with such processes. Perpendicularity of the container is the result.

Preferably, the size of the partial spheres 20, i.e., the radius of each partial sphere, depends on angle θ such that the larger the angle θ, the larger the radius of each partial sphere 20. For example, in one embodiment, for a container having a diameter of about 2.980 in., if angle θ is 45°, then the radius of each partial sphere is at least about 0.185 in. For the same container having an angle θ of 64°, the radius of each partial sphere is about 0.300 in. The partial sphere radius preferably accounts for from about 5% to 25% (and preferably from about 6% to 21%) of the diameter of the container base and the number of partial spheres may vary from about 5 to 11 (and preferably from 7 to 9) depending on the radius of the partial spheres.

Referring to FIG. 1 and FIG. 2, first rounded edge 4 and second rounded edge 5 each has a radius of curvature of from about 1.0 mm to about 14.0 mm. In preferred embodiments, each has a radius of curvature of from about 1.5 mm to about 6.0 mm. In more preferred embodiments, each has a radius of curvature of from about 2.0 mm to about 4.0 mm. Without intending to be bound by a particular theory, the radius of curvature of each radius functions to ensure that the area of the container represented by the first and second round edge does not stretch too much such that the areas may act as a hinge during pressure fluctuations experienced during a thermal cycle such as, for example, in a retort process. A radius of curvature greater than 14.0 mm will tend to stretch such that a hinge will be created.

Performance

When used in a hot-fill processing, the container is filled with a substance at an elevated temperature. The container is then sealed with, for example, a cap. As the temperature of the substance and air decreases to ambient temperatures, its volume decreases. The container and its base structure must react to the reduction in volume and accommodate the stresses and strains while remaining structurally sound. Moreover, the base must also be capable of withstanding various other forces, such as changes in internal pressure, and the usual handling forces.

During a retort or pasteurization process various food products are sterilized or heat treated after being sealed in a container such as by utilizing a retorting process in which the container that contains the food product is heated to relatively high temperatures such as in a range from about 121° C. to 132° C. or above. The containers can also be subjected to external pressurization during retorting to counteract an increase in internal pressure that can develop within the container as the contents are heated. The retort process, while being an efficient heat treating or sterilizing process, can be harsh on container components because of the temperature and pressure variations to which the container components are subjected. Materials that are commonly used for re-closable containers such as plastic bottles can soften and distort during retort processing.

The base structure according to embodiments of the present invention is shaped to withstand these various forces. The base structure reduces the need for plastic, yet still enhances the overall structural integrity of the container. The base structure of the present invention remains substantially un-deformed when the blow-molded container is filled with a liquid and sealed and subjected to a thermal process comprising heating the container to a temperature of from about 98° C. to about 127° C. for about 10 to about 40 minutes followed by cooling to about from 25° C. to about 37° C. in from about 10 minutes to about 30 minutes, such that the blow-molded container does not lean more than 1° relative to the central longitudinal axis.

Preferably, the base structure of the present invention remains substantially un-deformed when the blow-molded container is filled with a liquid and sealed and subjected to a thermal process comprising heating the container to a temperature of from about 108° C. to about 113° C. for about 20 to about 25 minutes followed by cooling to about 37° C. in from about 25 minutes to about 30 minutes, such that the blow-molded container does not lean more than 1° relative to the central longitudinal axis.

The performance of the bases of the present invention is illustrated by the following examples.

Figure 3:
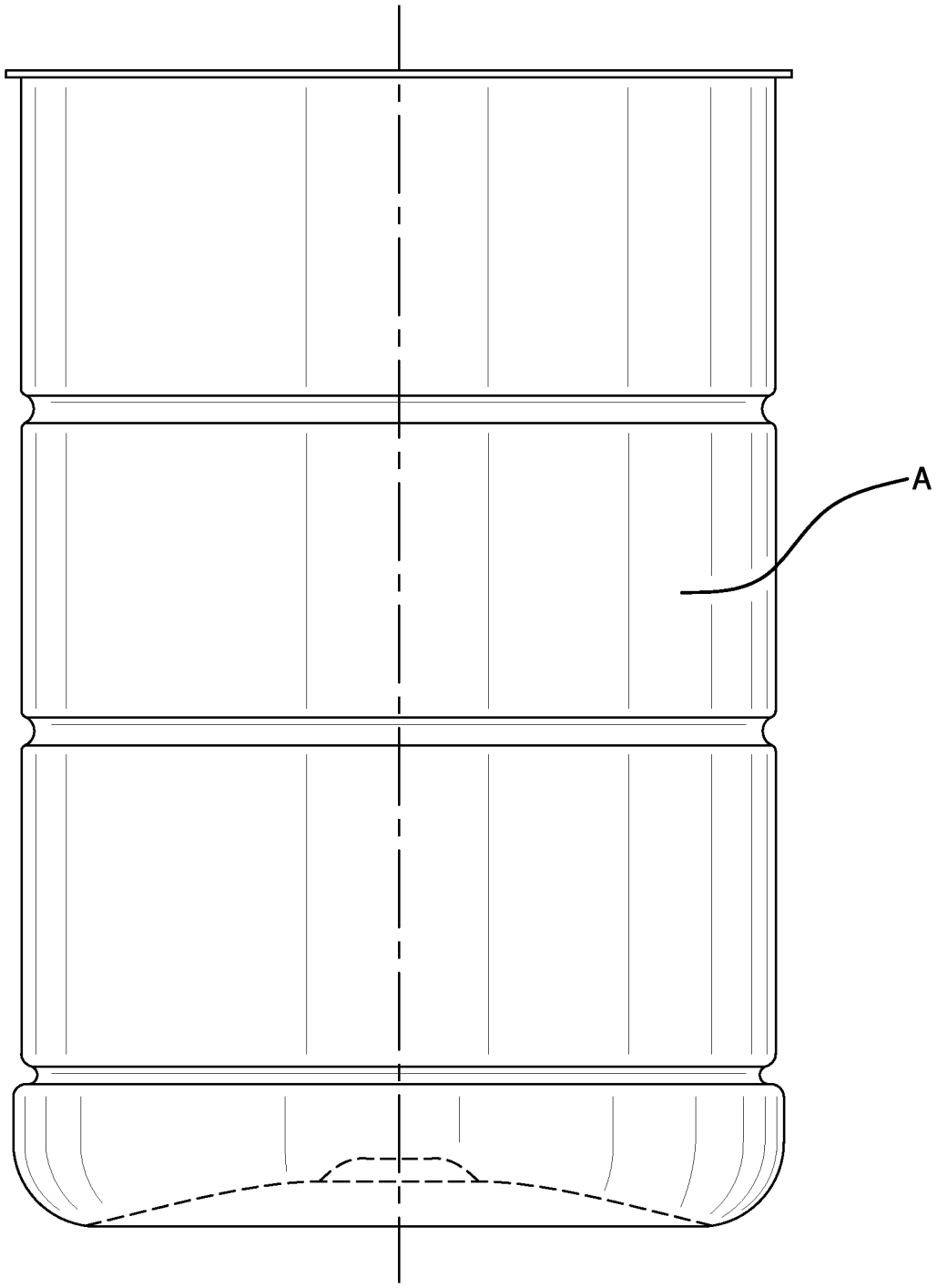
FIG. 3 (PRIOR ART)
FIG. 3 shows the profile of a container and base evaluated as a control or reference.

Seventy five (75) single layer 15-ounce PET containers having the general shape of a "can" but with a rounded base were made according to the manner described in U.S. patent application Publication No. 2012/0076965 (see FIG. 3, referred to herein as "Design A"). Another seventy five (75) single layer 15-ounce PET containers having the general shape of a "can" but with a wedge-shaped base containing partial spherical structures according to the present invention were made according to the manner described in U.S. patent application Publication No. 2012/0076965 (see, e.g., FIG. 1, referred to herein as "Design B"). The containers had a diameter of 2.980 inches. The containers were filled with water at a temperature of from 70 to 80° F., leaving a ¼ inch headspace gap. The containers were sealed with a metal easy opening end on an Angelus seamer.

The samples were subjected to the following retort conditions:

1. Temperature ramp from 76° F. to 225° F. for 10 minutes.
2. Hold at 225° F. for 20 minutes at 16.7 PSIG.
3. Cool from 225° F. to 72° F. for 30 minutes.
4. Cool to achieve temp of approximately 100° F. (inside PET container).

During such heating, the container may experience an internal pressure buildup of from about 0.1 bar to about 1.2 bar.

All containers where visually inspected for significant defects and their perpendicularity was measured. Perpendicularity can be measured according to any means known to those skilled in the art such as, for example, a calibrated bubble gauge (a type of level). No visible defects were noted on the sidewall panel portion of the containers.

Referring to Table 1 and Table 2, significant differences in perpendicularity were noted between the Design A containers and the Design B containers. The Design A containers had an 80% failure rate at 1.0° or less and a reduced failure rate of approximately 60% at 1.5° or less. The containers of Design B showed less than a 3% failure rate at 1.0° or less and 3% at 1.5° or less. This represents a greater than 27× improvement over the containers of Design A at 1.0° or less and over 20× improvement at 1.5° or less.

TABLE 1

| | Perpendicularity (target 1.0° or less) ¼" headspace | |
|---|---|---|
| | Design A | Design B |
| Total Pass | 15 | 73 |
| Total Possible | 75 | 75 |
| Total Tested | 75 | 75 |
| Percent Pass | 20% | 97% |
| PPM Defect | 800,000 | 26,667 |

TABLE 2

| | Perpendicularity (target 1.5° or less) ¼" headspace | |
|---|---|---|
| | Design A | Design B |
| Total Pass | 29 | 73 |
| Total Possible | 75 | 75 |

TABLE 2-continued

| | Perpendicularity (target 1.5° or less) ¼" headspace | |
|---|---|---|
| | Design A | Design B |
| Total Tested | 75 | 75 |
| Percent Pass | 39% | 97% |
| PPM Defect | 613,333 | 26,667 |

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. For example, the dimensions described above related to a specific embodiment of the invention. Other shapes and sizes of the inner projecting portion are possible within the scope of the invention. It is therefore to be understood that, within the scope of the claims and their equivalents, the invention may be practiced otherwise than as specifically described.

What is claimed is:

1. A base structure for a blow-molded container having an annular sidewall and a central longitudinal axis, the base structure comprising:

a bottom portion, having a flat outer surface;

a wedge-shaped annular support heel positioned between the sidewall and the bottom portion, wherein the wedge-shaped annular support heel is angled linearly and inwardly at an angle θ of from about 45° to about 65° relative a plane extending from the sidewall;

a plurality of partial sphere structures extending from the wedge-shaped annular support heel and beyond the bottom portion thus forming a spherical contact surface supporting the container; and a rounded edge between the wedge-shaped annular support heel and the bottom portion, wherein the rounded edge has a radius of curvature of from about 1.0 mm to about 14.0 mm, wherein the blow-molded container comprises a material selected from the group consisting of a polyester resin and polypropylene.

2. The base structure of claim 1 wherein the material is the polyester resin and is selected from the group consisting of poly(ethylene)terephthalate (PET), homopolymers of poly (ethylene)-phthalate, copolymers of poly(ethylene)terephthalate, poly(ethylene)isophthalate, poly(ethylene) naphthalate, poly(dimethylene)terephthalate, and poly (butylene)terephthalate.

3. The base structure of claim 1 wherein the rounded edge has a radius of curvature of from about 1.5 mm to about 6.0 mm.

4. The base structure of claim 3 wherein the rounded edge has a radius of curvature of from about 2.0 mm to about 4.0 mm.

5. The base structure of claim 1 wherein the material is polypropylene.

6. The base structure of claim 1 wherein the base remains substantially un-deformed when the blow-molded container is filled with a liquid and sealed and subjected to a thermal process comprising heating the container to a temperature of from about 98° C. to about 127° C. for about 10 to about 40 minutes followed by cooling to about from 25° C. to about 37° C. in from about 10 minutes to about 30 minutes, such that the blow-molded container does not lean more than 1° relative to the central longitudinal axis.

7. The base structure of claim 6 wherein the base remains substantially un-deformed when the blow-molded container is filled with a liquid and sealed and subjected to a thermal process comprising heating the container to a temperature of from about 108° C. to about 113° C. for about 20 to about 25 minutes followed by cooling to about 37° C. in from about 25 minutes to about 30 minutes, such that the blow-molded container does not lean more than 1° relative to the central longitudinal axis.

8. The base structure of claim 7 wherein the container experiences an internal pressure buildup of from about 0.1 bar to about 1.2 bar during heating.

9. The base structure of claim 7 wherein the container does not lean relative to the central longitudinal axis when the blow-molded container is subjected to the thermal process.

10. The base structure of claim 9 wherein the container experiences an internal pressure buildup of from about 0.1 bar to about 1.2 bar during heating.

11. The base structure of claim 6 wherein the container experiences an internal pressure buildup of from about 0.1 bar to about 1.2 bar during heating.

12. The base structure of claim 6 wherein the container does not lean relative to the central longitudinal axis when the blow-molded container is subjected to the thermal process.

13. The base structure of claim 12 wherein the container experiences an internal pressure buildup of from about 0.1 bar to about 1.2 bar during heating.

14. A base structure for a blow-molded container having an annular sidewall and a central longitudinal axis, the base structure comprising:

a bottom portion having a flat outer surface;

a wedge-shaped annular support heel positioned between the sidewall and the bottom portion, wherein the wedge-shaped annular support heel is angled linearly and inwardly at an angle θ of from about 45° to about 65° relative a plane extending from the sidewall;

a rounded edge between the wedge-shaped annular support heel and the bottom portion, wherein the rounded edge has a radius of curvature of from about 1.0 mm to about 14.0 mm; and a plurality of partial sphere structures extending from the wedge-shaped annular support heel and beyond the bottom portion thus forming a spherical contact surface supporting the container, wherein the blow-molded container comprises poly(ethylene)terephthalate (PET).

15. The base structure of claim 14 wherein the base remains substantially un-deformed when the blow-molded container is filled with a liquid and sealed and subjected to a thermal process comprising heating the container to a temperature of from about 98° C. to about 127° C. for about 10 to about 40 minutes followed by cooling to about from 25° C. to about 37° C. in from about 10 minutes to about 30 minutes, such that the blow-molded container does not lean more than 1° relative to the central longitudinal axis.

16. The base structure of claim 14 wherein the base remains substantially un-deformed when the blow-molded container is filled with a liquid and sealed and subjected to a thermal process comprising heating the container to a temperature of from about 108° C. to about 113° C. for about 20 to about 25 minutes followed by cooling to about 37° C. in from about 25 minutes to about 30 minutes, such that the blow-molded container does not lean more than 1° relative to the central longitudinal axis.

17. The base structure of claim 14 wherein the container experiences an internal pressure buildup of from about 0.1 bar to about 1.2 bar during heating.

18. The base structure of claim 14 wherein the container does not lean relative to the central longitudinal axis when the blow-molded container is subjected to the thermal process.

* * * * *